US010406598B2

(12) United States Patent
Cook, III et al.

(10) Patent No.: US 10,406,598 B2
(45) Date of Patent: Sep. 10, 2019

(54) MOLD ASSEMBLIES WITH INTEGRATED THERMAL MASS FOR FABRICATING INFILTRATED DOWNHOLE TOOLS

(71) Applicant: Halliburton Energy Services, Inc., Houston, TX (US)

(72) Inventors: Grant O. Cook, III, Spring, TX (US); Garrett T. Olsen, The Woodlands, TX (US); Jeffrey G. Thomas, Magnolia, TX (US); Clayton A. Ownby, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 163 days.

(21) Appl. No.: 14/779,028

(22) PCT Filed: Dec. 2, 2014

(86) PCT No.: PCT/US2014/068092
§ 371 (c)(1),
(2) Date: Sep. 22, 2015

(87) PCT Pub. No.: WO2016/089374
PCT Pub. Date: Jun. 9, 2016

(65) Prior Publication Data
US 2016/0325350 A1 Nov. 10, 2016

(51) Int. Cl.

| | |
|---|---|
| ***B22C 9/22*** | (2006.01) |
| ***B22D 19/06*** | (2006.01) |
| ***B22D 23/06*** | (2006.01) |
| ***B22D 27/04*** | (2006.01) |
| ***C22C 1/10*** | (2006.01) |
| ***E21B 10/00*** | (2006.01) |
| ***E21B 10/42*** | (2006.01) |
| ***B22C 9/00*** | (2006.01) |
| ***B22C 9/08*** | (2006.01) |
| ***B22D 19/14*** | (2006.01) |
| ***B22F 7/02*** | (2006.01) |
| *B22F 5/00* | (2006.01) |

(52) U.S. Cl.
CPC ..... *B22D 27/045* (2013.01); *B22C 9/00* (2013.01); *B22C 9/08* (2013.01); *B22C 9/22* (2013.01);
(Continued)

(58) Field of Classification Search
CPC .. B22C 9/02; B22C 9/065; B22C 9/08; B22C 9/22; B22D 19/06; B22D 23/06
(Continued)

(56) References Cited

U.S. PATENT DOCUMENTS 4,635,702 A 1/1987 Kolakowski et al.
5,275,227 A 1/1994 Staub
(Continued)

FOREIGN PATENT DOCUMENTS

KR 920000805 B1 1/1992

OTHER PUBLICATIONS

International Search Report and Written Opinion for PCT/US2014/068092 dated Sep. 2, 2015.

*Primary Examiner* — Kevin E Yoon
(74) *Attorney, Agent, or Firm* — Alan Bryson; C. Tumey Law Group PLLC

(57) ABSTRACT

An example mold assembly for fabricating an infiltrated downhole tool includes a mold defining a bottom of the mold assembly and a funnel operatively coupled to the mold. An infiltration chamber is defined at least partially by the mold and the funnel to receive and contain matrix reinforcement materials and a binder material used to form the infiltrated downhole tool. A thermal mass is positioned within the infiltration chamber above the infiltrated downhole tool for imparting heat to the infiltrated downhole tool following an infiltration process.

5 Claims, 8 Drawing Sheets

(52) U.S. Cl.
CPC ..... *B22D 19/06* (2013.01); *B22D 19/14* (2013.01); *B22D 23/06* (2013.01); *B22F 7/02* (2013.01); *C22C 1/1036* (2013.01); *E21B 10/00* (2013.01); *E21B 10/42* (2013.01); *B22F 2005/001* (2013.01); *B22F 2203/11* (2013.01); *B22F 2999/00* (2013.01)

(58) Field of Classification Search
USPC ..... 164/97, 98, 338.1, 348
See application file for complete search history.

(56) References Cited

U.S. PATENT DOCUMENTS 5,373,907 A * 12/1994 Weaver ..... C22C 1/1036 175/426
6,932,145 B2 8/2005 Frasier et al.
7,343,960 B1 3/2008 Frasier et al.
7,377,305 B2 5/2008 Frasier et al.
7,418,993 B2 9/2008 Frasier et al.
7,779,890 B2 8/2010 Frasier et al.
7,824,494 B2 11/2010 Frasier et al.
8,047,260 B2 11/2011 Uno et al.
8,082,976 B2 12/2011 Frasier et al.
8,087,446 B2 1/2012 Frasier et al.
8,181,692 B2 5/2012 Frasier et al.
8,272,295 B2 9/2012 Smith et al.
8,550,144 B2 10/2013 Frasier et al.
2008/0028891 A1 2/2008 Calnan et al.
2010/0212860 A1 8/2010 Rule
2011/0121475 A1* 5/2011 Reese ..... B22D 19/14 264/37.1
2011/0167734 A1 7/2011 Jiang et al.
2012/0298323 A1* 11/2012 Thomas ..... B22F 3/004 164/97
2013/0313403 A1* 11/2013 Atkins ..... B22C 9/22 249/135
2013/0333950 A1 12/2013 Atkins et al.

* cited by examiner

MOLD ASSEMBLIES WITH INTEGRATED THERMAL MASS FOR FABRICATING INFILTRATED DOWNHOLE TOOLS

BACKGROUND

A variety of downhole tools are commonly used in the exploration and production of hydrocarbons. Examples of such downhole tools include cutting tools, such as drill bits, reamers, stabilizers, and coring bits; drilling tools, such as rotary steerable devices and mud motors; and other downhole tools, such as window mills, packers, tool joints, and other wear-prone tools. Rotary drill bits are often used to drill wellbores. One type of rotary drill bit is a fixed-cutter drill bit that has a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body.

Matrix drill bits are typically manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement materials within interior portions of the mold cavity. A preformed bit blank (or steel mandrel) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and the temperature of the mold is increased to a desired temperature to allow the binder (e.g., metallic alloy) to liquefy and infiltrate the matrix reinforcement material. The furnace typically maintains this desired temperature to the point that the infiltration process is deemed complete, such as when a specific location in the bit reaches a certain temperature. Once the designated process time or temperature has been reached, the mold containing the infiltrated matrix bit is removed from the furnace. As the mold is removed from the furnace, the mold begins to rapidly lose heat to its surrounding environment via heat transfer, such as radiation and/or convection in all directions.

This heat loss continues to a large extent until the mold is moved and placed on a cooling plate and an insulation enclosure or "hot hat" is lowered around the mold. The insulation enclosure drastically reduces the rate of heat loss from the top and sides of the mold while heat is drawn from the bottom of the mold through the cooling plate. This controlled cooling of the mold and the infiltrated matrix bit contained therein can facilitate axial solidification dominating radial solidification, which is loosely termed directional solidification.

As the molten material of the infiltrated matrix bit cools, there is a tendency for shrinkage that could result in voids forming within the bit body unless the molten material is able to continuously backfill such voids. In some cases, for instance, one or more intermediate regions within the bit body may solidify prior to adjacent regions and thereby stop the flow of molten material to locations where shrinkage porosity is developing. In other cases, shrinkage porosity may result in poor metallurgical bonding at the interface between the bit blank and the molten materials, which can result in the formation of cracks within the bit body that can be difficult or impossible to inspect. When such bonding defects are present and/or detected, the drill bit is often scrapped during or following manufacturing assuming they cannot be remedied. Every effort is made to detect these defects and reject any defective drill bit components during manufacturing to help ensure that the drill bits used in a job at a well site will not prematurely fail and to minimize any risk of possible damage to the well.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to downhole tool manufacturing and, more particularly, to mold assembly configurations that include an integrated thermal mass to help control the thermal profile of an infiltrated downhole tool during manufacture.

Figure 1:
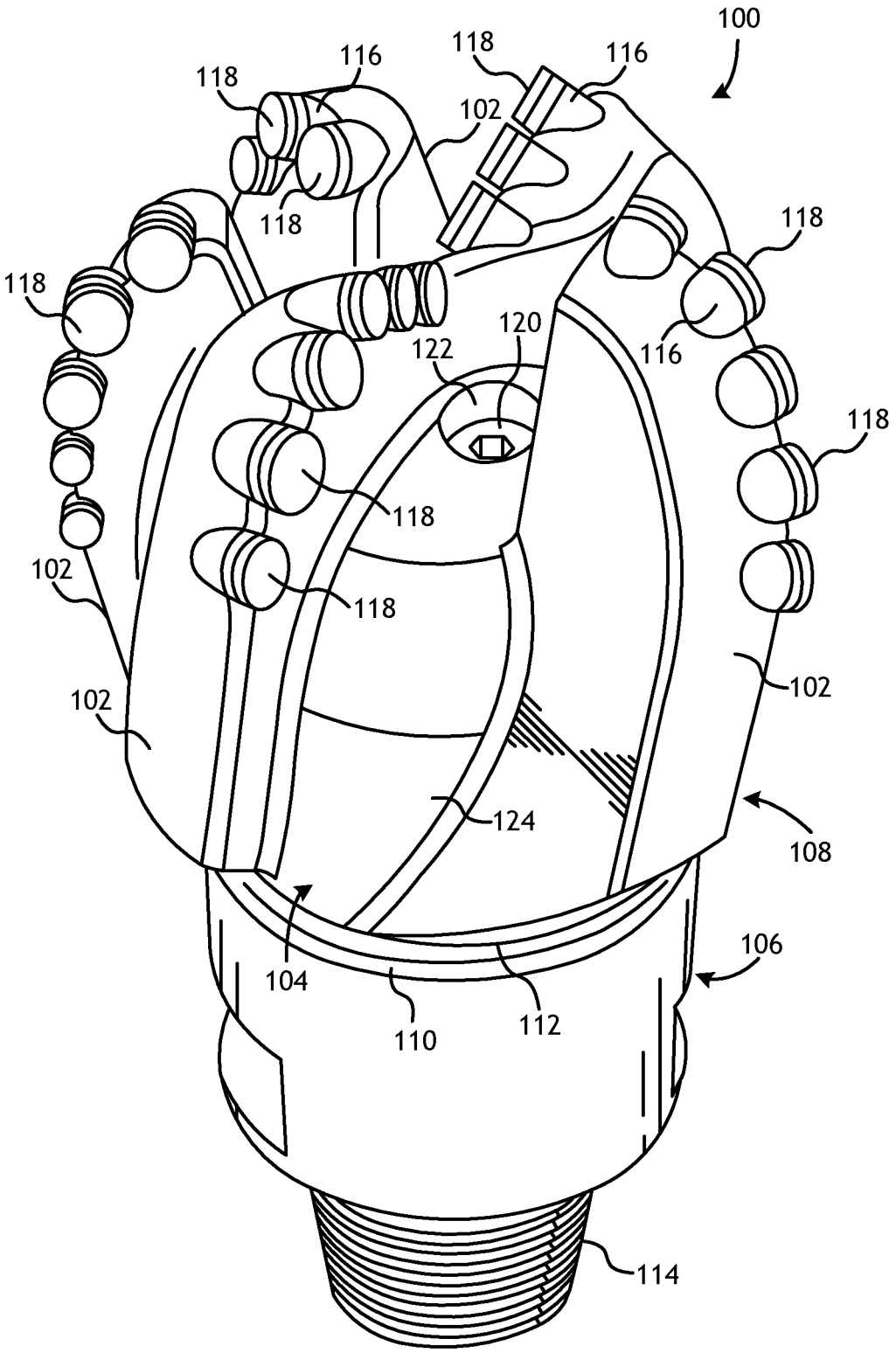
FIG. 1 is a perspective view of an exemplary fixed-cutter drill bit that may be fabricated in accordance with the principles of the present disclosure.

The embodiments described herein improve directional solidification of infiltrated downhole tools by introducing alternative designs to mold assemblies used during the infiltration process to thereby achieve a desired thermal profile. The mold assemblies described herein may include a mold that forms a bottom of the mold assembly and a funnel that is operatively coupled to the mold. An infiltration chamber may be defined at least partially by the mold and the funnel and may receive and contain matrix reinforcement materials and a binder material used to form the infiltrated downhole tool. A thermal mass may be positioned within the infiltration chamber above the infiltrated downhole tool. The mold assembly may be placed within a furnace to heat the matrix reinforcement materials and the binder material and eventually infiltrate the matrix reinforcement materials with the binder material. The furnace may also serve to heat the thermal mass, and after the mold assembly is removed from the furnace, the thermal mass may impart heat to the top of the infiltrated downhole tool. Accordingly, the mold assemblies described herein may prove advantageous in passively improving directional solidification of an infiltrated downhole tool. Among other things, this may improve quality and reduce the rejection rate of drill bit components due to defects during manufacturing FIG. 1 illustrates a perspective view of an example fixed-cutter drill bit 100 that may be fabricated in accordance with the principles of the present disclosure. It should be noted that, while FIG. 1 depicts a fixed-cutter drill bit 100, the principles of the present disclosure are equally applicable to any type of downhole tool that may be formed or otherwise manufactured through an infiltration process. For example, suitable infiltrated downhole tools that may be manufactured in accordance with the present disclosure include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters, cutting elements), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

As illustrated in FIG. 1, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple recesses or pockets 116 are formed. Cutting elements 118 may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
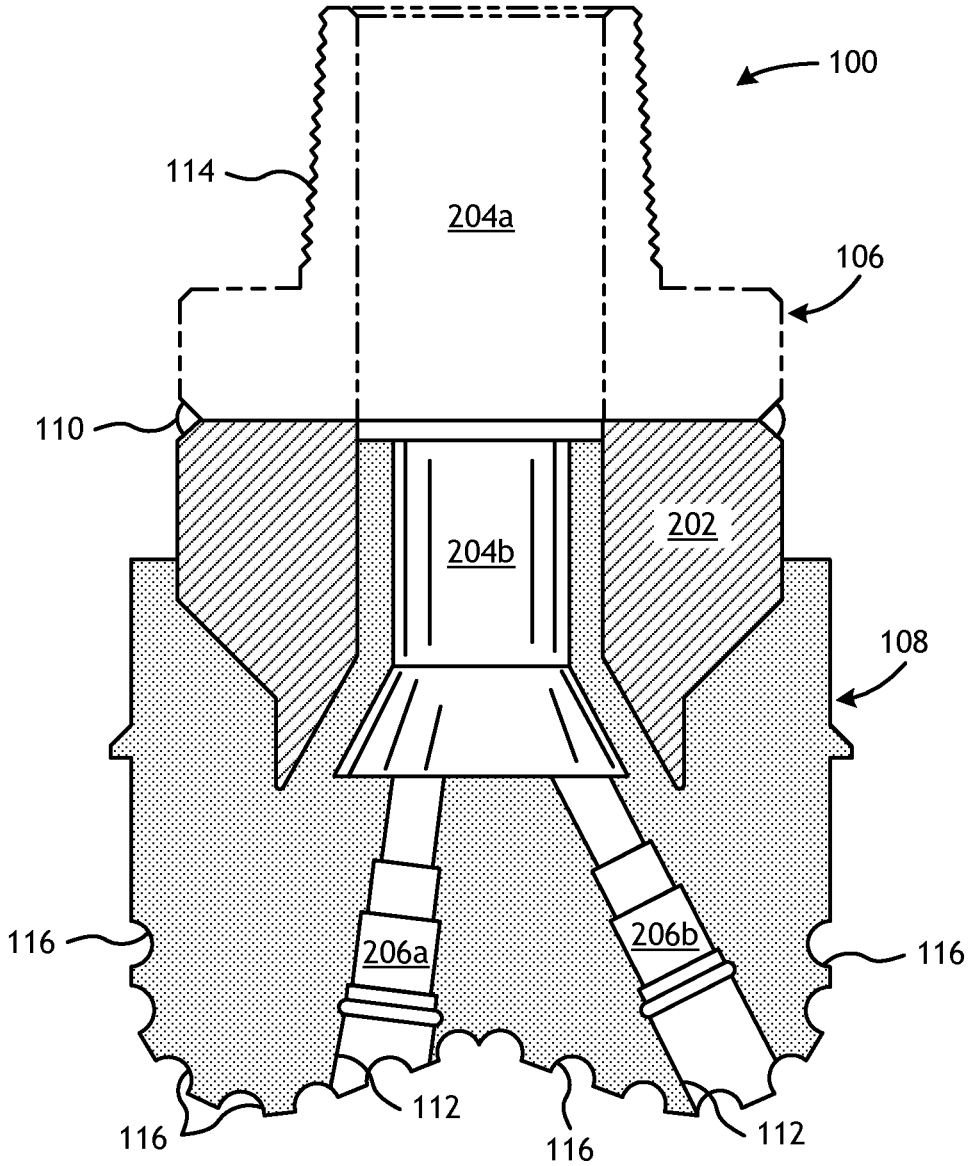
FIG. 2 is a cross-sectional view of the drill bit of FIG. 1.

FIG. 2 is a cross-sectional side view of the drill bit 100 of FIG. 1. Similar numerals from FIG. 1 that are used in FIG. 2 refer to similar components that are not described again. As illustrated, the shank 106 may be securely attached to a metal blank (or mandrel) 202 at the weld 110 and the metal blank 202 extends into the bit body 108. The shank 106 and the metal blank 202 are generally cylindrical structures that define corresponding fluid cavities 204*a* and 204*b*, respectively, in fluid communication with each other. The fluid cavity 204*b* of the metal blank 202 may further extend longitudinally into the bit body 108. At least one flow passageway (shown as two flow passageways 206*a* and 206*b*) may extend from the fluid cavity 204*b* to exterior portions of the bit body 108. The nozzle openings 122 may be defined at the ends of the flow passageways 206*a* and 206*b* at the exterior portions of the bit body 108. The pockets 116 are formed in the bit body 108 and are shaped or otherwise configured to receive the cutting elements 118 (FIG. 1).

Figure 3:
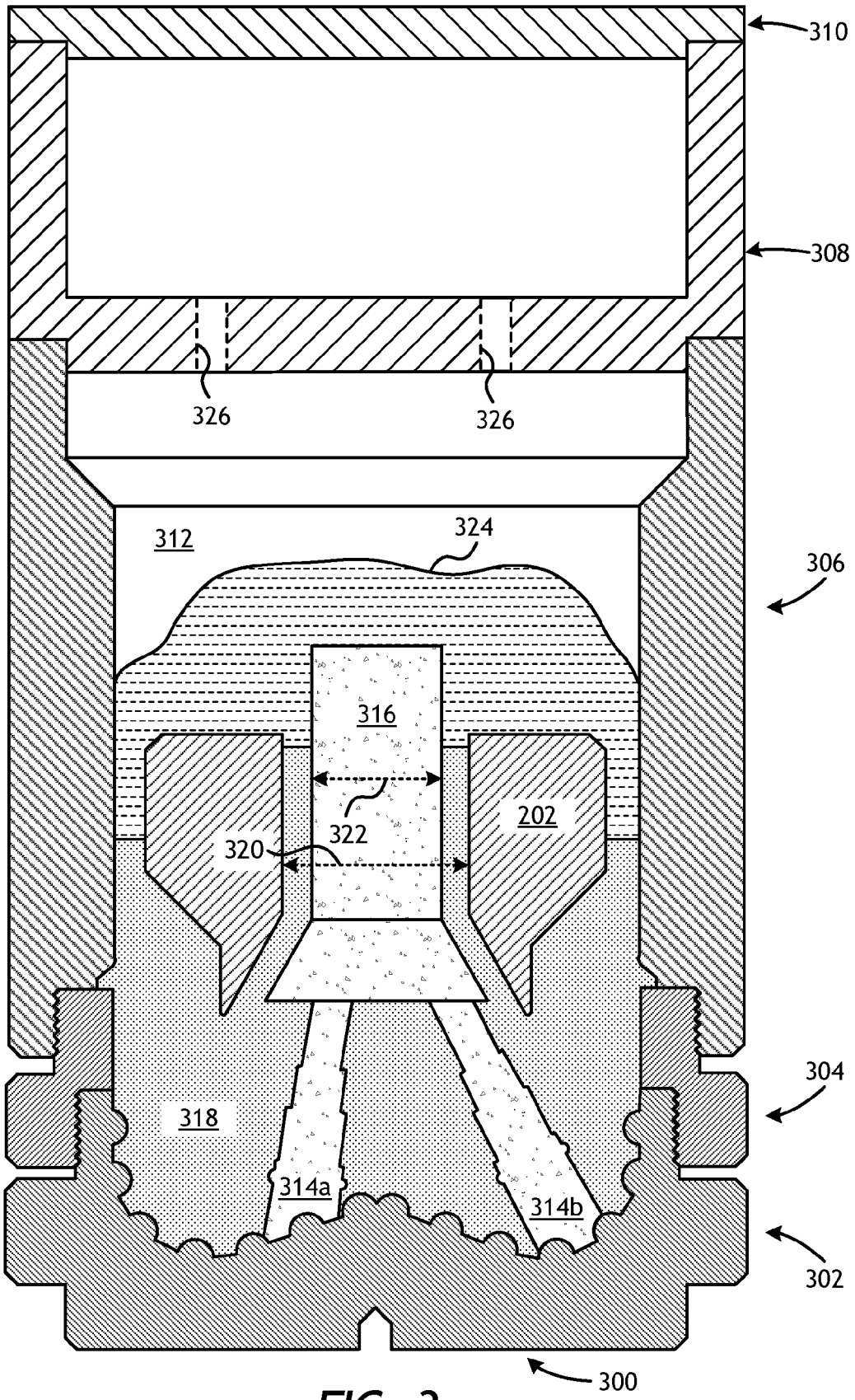
FIG. 3 is a cross-sectional side view of an exemplary mold assembly for use in forming the drill bit of FIG. 1.

FIG. 3 is a cross-sectional side view of a mold assembly 300 that may be used to form the drill bit 100 of FIGS. 1 and 2. While the mold assembly 300 is shown and discussed as being used to help fabricate the drill bit 100, those skilled in the art will readily appreciate that mold assembly 300 and its several variations described herein may be used to help fabricate any of the infiltrated downhole tools mentioned above, without departing from the scope of the disclosure. As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In other embodiments, the gauge ring 304 may be omitted from the mold assembly 300 and the funnel 306 may be instead be operatively coupled directly to the mold 302, such as via a corresponding threaded engagement, without departing from the scope of the disclosure.

In some embodiments, as illustrated, the mold assembly 300 may further include a binder bowl 308 and a cap 310 placed above the funnel 306. The mold 302, the gauge ring 304, the funnel 306, the binder bowl 308, and the cap 310 may each be made of or otherwise comprise graphite or alumina ($Al_2O_3$), for example, or other suitable materials. An infiltration chamber 312 may be defined or otherwise provided within the mold assembly 300. Various techniques may be used to manufacture the mold assembly 300 and its components including, but not limited to, machining graphite blanks to produce the various components and thereby define the infiltration chamber 312 to exhibit a negative or reverse profile of desired exterior features of the drill bit 100 (FIGS. 1 and 2).

Materials, such as consolidated sand or graphite, may be positioned within the mold assembly 300 at desired locations to form various features of the drill bit 100 (FIGS. 1 and 2). For example, consolidated sand legs 314*a* and 314*b* may be positioned to correspond with desired locations and configurations of the flow passageways 206*a,b* (FIG. 2) and their respective nozzle openings 122 (FIGS. 1 and 2). Moreover, a cylindrically-shaped consolidated central displacement 316 may be placed on the legs 314*a,b*. The number of legs 314*a,b* extending from the central displacement 316 will depend upon the desired number of flow passageways and corresponding nozzle openings 122 in the drill bit 100.

After the desired materials, including the central displacement 316 and the legs 314*a,b*, have been installed within the mold assembly 300, matrix reinforcement materials 318 may then be placed within or otherwise introduced into the mold assembly 300. For some applications, two or more different types of matrix reinforcement materials 318 may be deposited in the mold assembly 300. Suitable matrix reinforcement materials 318 include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used.

The metal blank 202 may be supported at least partially by the matrix reinforcement materials 318 within the infiltration chamber 312. More particularly, after a sufficient volume of the matrix reinforcement materials 318 has been added to the mold assembly 300, the metal blank 202 may then be placed within mold assembly 300. The metal blank 202 may include an inside diameter 320 that is greater than an outside diameter 322 of the central displacement 316, and various fixtures (not expressly shown) may be used to position the metal blank 202 within the mold assembly 300 at a desired location. The matrix reinforcement materials 318 may then be filled to a desired level within the infiltration chamber 312.

Binder material 324 may then be placed on top of the matrix reinforcement materials 318, the metal blank 202, and the central displacement 316. Various types of binder materials 324 may be used and include, but are not limited to, metallic alloys of copper (Cu), nickel (Ni), manganese (Mn), lead (Pb), tin (Sn), cobalt (Co) and silver (Ag). Phosphorous (P) may sometimes also be added in small quantities to reduce the melting temperature range of infiltration materials positioned in the mold assembly 300. Various mixtures of such metallic alloys may also be used as the binder material 324. In some embodiments, the binder material 324 may be covered with a flux layer (not expressly shown). The amount of binder material 324 and optional flux material added to the infiltration chamber 312 should be at least enough to infiltrate the matrix reinforcement materials 318 during the infiltration process. In some instances, some or all of the binder material 324 may be placed in the binder bowl 308, which may be used to distribute the binder material 324 into the infiltration chamber 312 via various conduits 326 that extend therethrough. The cap 310 (if used) may then be placed over the mold assembly 300, thereby readying the mold assembly 300 for heating.

Figure 4A:
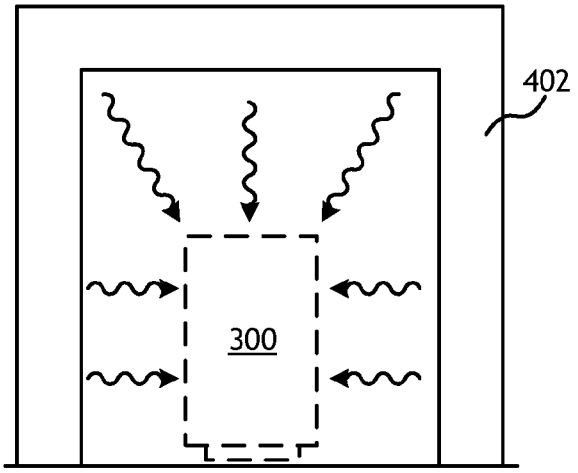
FIGS. 4A-4C are progressive schematic diagrams of an exemplary method of fabricating a drill bit.
Figure 4B:
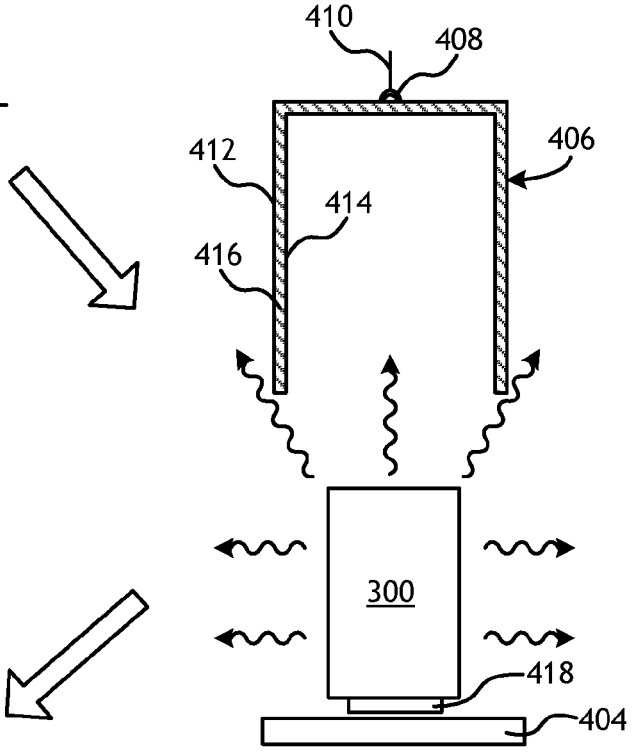
Figure 4C:
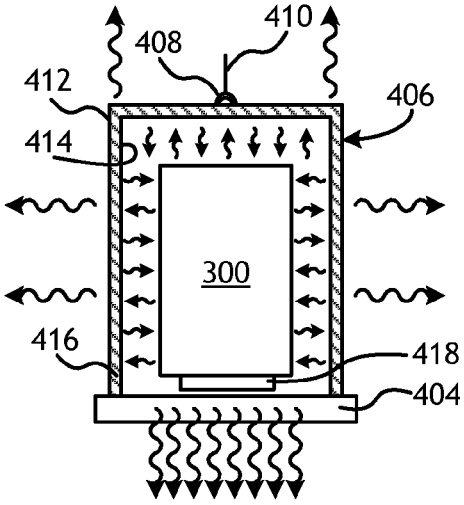

Referring now to FIGS. 4A-4C, with continued reference to FIG. 3, illustrated are schematic diagrams that sequentially illustrate an example method of heating and cooling the mold assembly 300 of FIG. 3, in accordance with the principles of the present disclosure. In FIG. 4A, the mold assembly 300 is depicted as being positioned within a furnace 402. The temperature of the mold assembly 300 and its contents are elevated within the furnace 402 until the binder material 324 liquefies and is able to infiltrate the matrix reinforcement materials 318. Once a specific location in the mold assembly 300 reaches a certain temperature in the furnace 402, or the mold assembly 300 is otherwise maintained at a particular temperature for a predetermined amount of time, the mold assembly 300 is then removed from the furnace 402 and immediately begins to lose heat by radiating thermal energy to its surroundings while heat is also convected away by cooler air outside the furnace 402. In some cases, as depicted in FIG. 4B, the mold assembly 300 may be transported to and set down upon a thermal heat sink 404.

The radiative and convective heat losses from the mold assembly 300 to the environment continue until an insulation enclosure 406 is lowered around the mold assembly 300. The insulation enclosure 406 may be a rigid shell or structure used to insulate the mold assembly 300 and thereby slow the cooling process. In some cases, the insulation enclosure 406 may include a hook 408 attached to a top surface thereof. The hook 408 may provide an attachment location, such as for a lifting member, whereby the insulation enclosure 406 may be grasped and/or otherwise attached to for transport. For instance, a chain or wire 410 may be coupled to the hook 408 to lift and move the insulation enclosure 406, as illustrated. In other cases, a mandrel or other type of manipulator (not shown) may grasp onto the hook 408 to move the insulation enclosure 406 to a desired location.

The insulation enclosure 406 may include an outer frame 412, an inner frame 414, and insulation material 416 arranged between the outer and inner frames 412, 414. In some embodiments, both the outer frame 412 and the inner frame 414 may be made of rolled steel and shaped (i.e., bent, welded, etc.) into the general shape, design, and/or configuration of the insulation enclosure 406. In other embodiments, the inner frame 414 may be a metal wire mesh that holds the insulation material 416 between the outer frame 412 and the inner frame 414. The insulation material 416 may be selected from a variety of insulative materials, such as those discussed below. In at least one embodiment, the insulation material 416 may be a ceramic fiber blanket, such as INSWOOL® or the like.

As depicted in FIG. 4C, the insulation enclosure 406 may enclose the mold assembly 300 such that thermal energy radiating from the mold assembly 300 is dramatically reduced from the top and sides of the mold assembly 300 and is instead directed substantially downward and otherwise toward/into the thermal heat sink 404 or back towards the mold assembly 300. In the illustrated embodiment, the thermal heat sink 404 is a cooling plate designed to circulate a fluid (e.g., water) at a reduced temperature relative to the mold assembly 300 (i.e., at or near ambient) to draw thermal energy from the mold assembly 300 and into the circulating fluid, and thereby reduce the temperature of the mold assembly 300. In other embodiments, however, the thermal heat sink 404 may be any type of cooling device or heat exchanger configured to encourage heat transfer from the bottom 418 of the mold assembly 300 to the thermal heat sink 404. In yet other embodiments, the thermal heat sink 404 may be any stable or rigid surface that may support the mold assembly 300, and preferably having a high thermal capacity, such as a concrete slab or flooring.

Once the insulation enclosure 406 is positioned over the mold assembly 300 and the thermal heat sink 404 is operational, the majority of the thermal energy is transferred away from the mold assembly 300 through the bottom 418 of the mold assembly 300 and into the thermal heat sink 404. This controlled cooling of the mold assembly 300 and its contents allows an operator to regulate or control the thermal profile of the mold assembly 300 to a certain extent and may result in directional solidification of the molten contents within the mold assembly 300, where axial solidification of the molten contents dominates radial solidification. Within the mold assembly 300, the face of the drill bit (i.e., the end of the drill bit that includes the cutters) may be positioned at the bottom 418 of the mold assembly 300 and otherwise adjacent the thermal heat sink 404 while the shank 106 (FIG. 1) may be positioned adjacent the top of the mold assembly 300. As a result, the drill bit 100 (FIGS. 1 and 2) may be cooled axially upward, from the cutters 118 (FIG. 1) toward the shank 106 (FIG. 1).

Such directional solidification (from the bottom up) may prove advantageous in reducing the occurrence of voids due to shrinkage porosity, cracks at the interface between the bit blank and the molten materials, and nozzle cracks. However, the insulating capability of the insulation enclosure 406 may require augmentation to produce a sufficient amount of directional cooling. According to embodiments of the present disclosure, as an alternative or in addition to using the insulation enclosure 406, the mold assemblies described herein may be modified to help influence the overall thermal profile of the infiltrated downhole tool being fabricated and thereby enhance directional cooling. More particularly, embodiments of the presently described mold assemblies include a thermal mass that is capable of passively improving directional solidification of an infiltrated downhole tool.

Figure 5B:
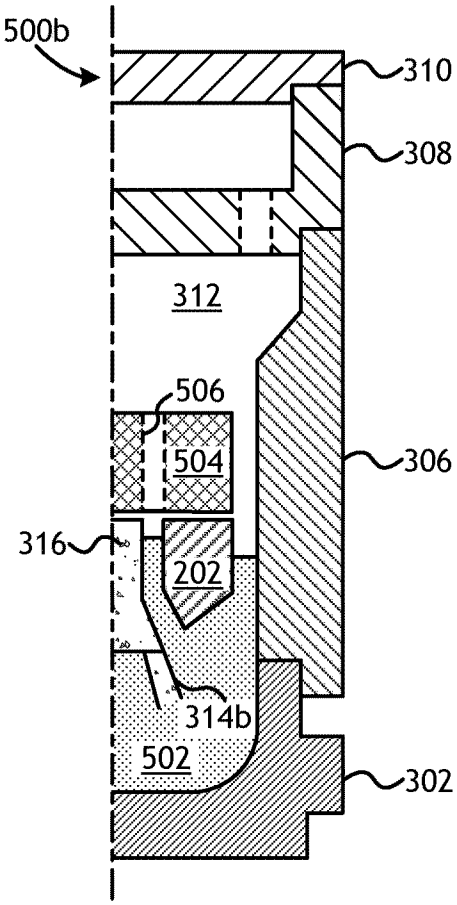
FIGS. 5A and 5B are partial cross-sectional side views of two exemplary mold assemblies.
Figure 5A:
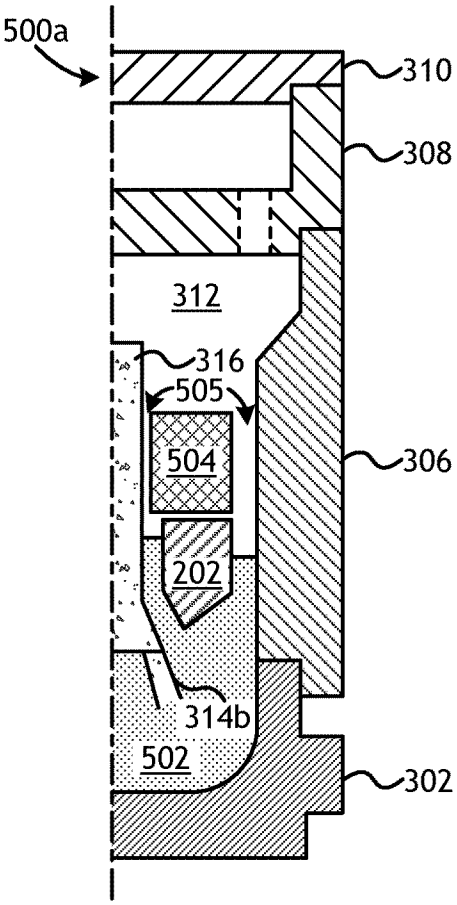

Referring now to FIGS. 5A and 5B, illustrated are partial cross-sectional side views of exemplary mold assemblies 500 used to fabricate an infiltrated downhole tool 502, according to one or more embodiments. More particularly, FIG. 5A depicts a first mold assembly 500*a*, FIG. 5B depicts a second mold assembly 500*b*, and the infiltrated downhole tool 502 may comprise any of the infiltrated downhole tools mentioned herein.

The mold assemblies 500*a,b* may be similar in some respects to the mold assembly 300 of FIG. 3 and therefore may be best understood with reference thereto, where like numerals represent like elements or components not described again. Each mold assembly 500*a,b* may include some or all of the component parts of the mold assembly 300 of FIG. 3. For instance, as illustrated, the mold assemblies 500*a,b* may each include some or all of the mold 302, the funnel 306, the binder bowl 308, and the cap 310. In some embodiments, while not shown in FIGS. 5A and 5B, the gauge ring 304 (FIG. 3) may also be included in either of the mold assemblies 500*a,b*. Each mold assembly 500*a,b* may further include the metal blank 202, the central displacement 316, and one or more consolidated sand legs 314*b* (one shown), as generally described above. The foregoing components of the mold assemblies 500*a,b* are collectively referred to herein as the "component parts" of the mold assemblies 500*a,b* and any of the other mold assemblies described herein.

According to the present disclosure, the mold assemblies 500*a,b* may each further include a thermal mass 504 positioned within the infiltration chamber 312 to retain and/or impart additional heat within the given mold assembly 500*a,b* above the infiltrated downhole tool 502 following the above-described infiltration process. The thermal mass 504 may be characterized as a "passive thermal mass" configured to impart thermal energy to the infiltrated downhole tool 502 to alter its thermal profile. As a result, the thermal mass 504 may help maintain high temperatures at the top of the infiltrated downhole tool 502 while the bottom of the infiltrated downhole tool 502 and the mold assembly 500*a,b* are cooled.

In some embodiments, the thermal mass 504 may be placed within the mold assembly 500*a,b* prior to introducing the mold assembly 500*a,b* into the furnace 402 (FIG. 4A). While in the furnace 402, and during the infiltration process described above, the temperature of the thermal mass 504 may increase such that the thermal mass 504 can subsequently serve as a thermal reservoir when the mold assembly 500*a,b* is removed from the furnace 402. Suitable materials for the thermal mass 504 include, but are not limited to, a ceramic (e.g., oxides, carbides, borides, nitrides, silicides), a metal (e.g., steel, stainless steel, nickel, tungsten, titanium or alloys thereof), fireclay, fire brick, stone, graphite, and any combination thereof. Alternatively, the thermal mass 504 may comprise a multi-component mass or otherwise consist of several pieces or fragments of a material and, in some embodiments, may be contained or otherwise retained within a suitable vessel or container disposable within (i.e., able to be introduced into) the infiltration chamber 312 and able to survive heating within the furnace 402 (FIG. 4A). In such embodiments, the thermal mass 504 may include blocks, fibers, fabrics, wools, beads, particulates, flakes, sheets, bricks, a moldable ceramic, woven ceramics, cast ceramics, metal foams, metal castings, sprayed insulation, any composite thereof, and any combination thereof.

In some embodiments, the thermal mass 504 may comprise a phase changing material contained or otherwise retained within a suitable vessel or container disposable within (i.e., able to be introduced into) the infiltration chamber 312 and able to survive heating within the furnace 402 (FIG. 4A). The phase changing material may be capable of passing through a phase change, such as from a solid state to a liquid or molten state. In such embodiments, the thermal mass 504 may be configured to pass through solid/liquid phases at a specific temperature or at a predetermined time. Suitable phase changing materials for the thermal mass 504 include, but are not limited to, metals, salts, and exothermic powders. Suitable metals for the phase change thermal material may include a metal similar to the binder material 324 of FIG. 3 such as, but not limited to, copper, nickel, manganese, lead, tin, cobalt, silver, phosphorous, zinc, any alloys thereof, and any mixtures of the metallic alloys. Using a phase changing material that is similar to the binder material 324 may prove advantageous since they will each have the same solidus and liquidus temperatures. As a result, the phase changing material may be able to provide latent heat to the molten contents of the mold assembly 500*a,b* at essentially the same thermal points. Suitable exothermic powders for the phase changing material may include a hot topping compound, such as FEEDOL®, which is commonly used in foundries.

In some embodiments, the thermal mass 504 may be placed within the infiltration chamber 312 atop and in direct contact with the metal blank 202. In other embodiments, the thermal mass 504 may form an integral part or extension of the metal blank 202. In such embodiments, the metal blank 202 and the thermal mass 504 may be made of the same material or otherwise coupled (e.g., welded, brazed, mechanically fastened, etc.) to form a monolithic component part of the assembly 500*a,b*.

The thermal mass 504 may exhibit a variety of shapes, sizes, thicknesses (i.e., depths), configurations, etc., without departing from the scope of the disclosure. In FIG. 5A, for example, the thermal mass 504 is depicted as an annular ring that extends around the central displacement 316. The annular ring may comprise a solid ring or consist of two or more arcuate segments. Similar to the metal blank 202, the annular thermal mass 504 in FIG. 5A may exhibit an inside diameter that is greater than the outside diameter 322 (FIG. 3) of the central displacement 316, thereby allowing the thermal mass 504 to be arranged about the outer periphery of the central displacement 316. Gaps 505 defined between the thermal mass 504 and the central displacement 316, and between the thermal mass 504 and the inner wall of the funnel 306, may allow the binder material 324 (FIG. 3) to flow around the thermal mass 504 during the infiltration process.

It should be noted that, while only one thermal mass 504 in the form of an annular ring is depicted in FIG. 5A, it is contemplated herein to use more than one annular ring where two or more thermal masses 504 are stacked atop one another in the form of annular rings. In some embodiments, the materials of each annular ring may be the same or different, without departing from the scope of the disclosure.

In FIG. 5B, the height of the central displacement 316 is reduced to accommodate a disk-shaped thermal mass 504. In such embodiments, the disk-shaped thermal mass 504 may be positioned within the infiltration chamber 312 such that it extends over the central displacement 316 and may be in contact with one or both of the central displacement 316 and the metal blank 202. As with the thermal mass 504 in FIG. 5A, the disk-shaped thermal mass 504 may comprise a solid disk structure or may otherwise consist of two or more segments or sections. In some embodiments, one or more flow conduits 506 (one shown) may be defined through the thermal mass 504 to enable the binder material 324 (FIG. 3) to flow through the thermal mass 504.

Figure 6A:
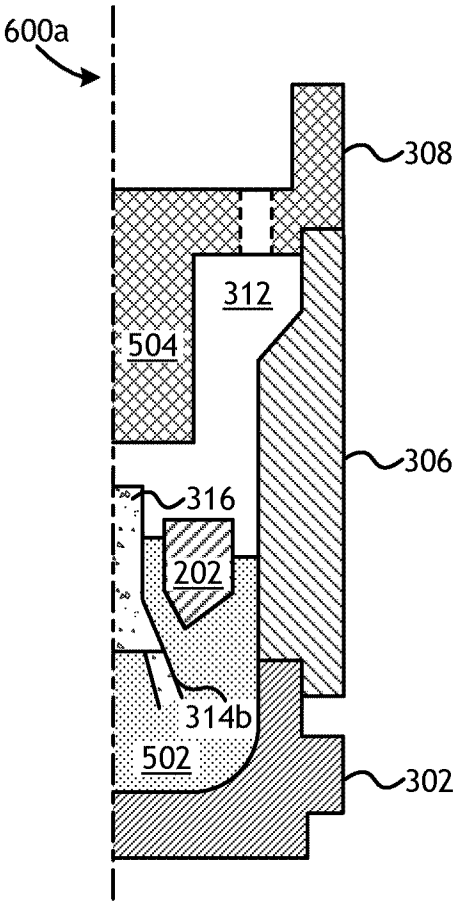
FIGS. 6A and 6B are partial cross-sectional side views additional exemplary mold assemblies.
Figure 6B:
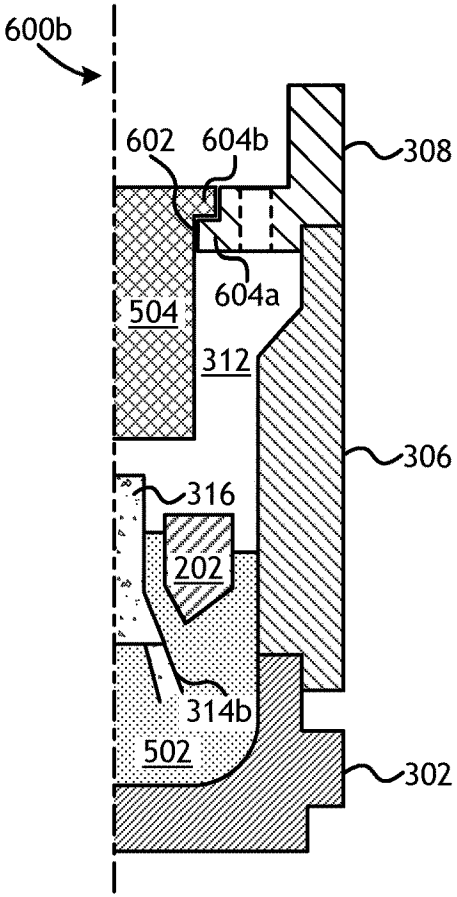

Referring now to FIGS. 6A and 6B, illustrated are partial cross-sectional side views of additional exemplary mold assemblies 600 used to fabricate the infiltrated downhole tool 502, according to one or more embodiments. More particularly, FIG. 6A depicts a third mold assembly 600*a* and FIG. 6B depicts a fourth mold assembly 600*b*. Similar to the mold assemblies 500*a,b* of FIGS. 5A-5B, the mold assemblies 600*a,b* may be similar in some respects to the mold assembly 300 of FIG. 3. As illustrated, the mold assemblies 600*a,b* may each include one or more of the mold 302, the funnel 306, and the binder bowl 308, but could alternatively also include the cap 310 (FIG. 3) and the gauge ring 304 (FIG. 3), without departing from the scope of the disclosure. Each mold assembly 600*a,b* may further include the metal blank 202, the central displacement 316, and one or more consolidated sand legs 314*b* (one shown).

Moreover, similar to the mold assemblies 500*a,b* of FIGS. 5A-5B, the mold assemblies 600*a,b* may each include the thermal mass 504 positioned within the infiltration chamber 312 to retain and/or impart additional heat within the mold assembly 600*a,b* above the infiltrated downhole tool 502 following the infiltration process. Unlike the mold assemblies 500*a,b*, however, the thermal mass in the mold assemblies 600*a,b* may be integrated with the binder bowl 308 set atop the funnel 306. In FIG. 6A, for example, the thermal mass 504 may form an integral part or extension of the binder bowl 308. As illustrated, the thermal mass 504 may extend longitudinally from the binder bowl 308 into the infiltration chamber 312 and toward the central displacement 316. In some embodiments, the height of the central displacement 316 may be reduced to accommodate the volume of the thermal mass 504. In such embodiments, the binder bowl 308 and the thermal mass 504 may be made of the same material or otherwise coupled (e.g., welded, brazed, mechanically fastened, etc.) to form a monolithic component part of the given assembly 600*a,b*.

In FIG. 6B, the thermal mass 504 is integrated with the binder bowl 308 in a two-piece construction, where the thermal mass 504 is configured to rest on and otherwise be supported by the binder bowl 308 and extend into the infiltration chamber 312 therefrom. More particularly, the binder bowl 308 may define a central aperture 602 and a radial shoulder 604*a* configured to receive and support the thermal mass 504. The thermal mass 504 may provide or otherwise define a shoulder 604*b* configured to engage and rest on the radial shoulder 604*a* and thereby "hang off" the binder bowl 308 into the infiltration chamber 312. Those skilled in the art will readily recognize the several potential variations of hanging the thermal mass 504 from the binder bowl 308, without departing from the scope of the disclosure. In some embodiments, for instance, the thermal mass 504 may alternatively be mechanically fastened to the binder bowl 308, such as through the use of one or more mechanical fasteners (e.g., screws, bolts, pins, snap rings, etc.).

The mold assembly 600*b* may prove advantageous in providing a removable or interchangeable thermal mass 504. For instance, a first thermal mass 504 made of a particular material that exhibits a corresponding specific heat capacity may be removed from the mold assembly and replaced with a second thermal mass 504 made of a second material that exhibits a different specific heat capacity. As a result, an operator may be able to optimize operation of the mold assembly 600*b* by using different materials for the thermal mass 504. For instance, the thermal mass 504 may be made out of two or more materials (welded or mechanically joined, etc.) so that the cooling process may be optimized if response is needed in between set thermal properties of selected materials of the thermal masses 504. This could also be used to lighten the thermal mass 504 if it proves to be too heavy for the mold 302 that ultimately supports the suspended weight.

Figure 7B:
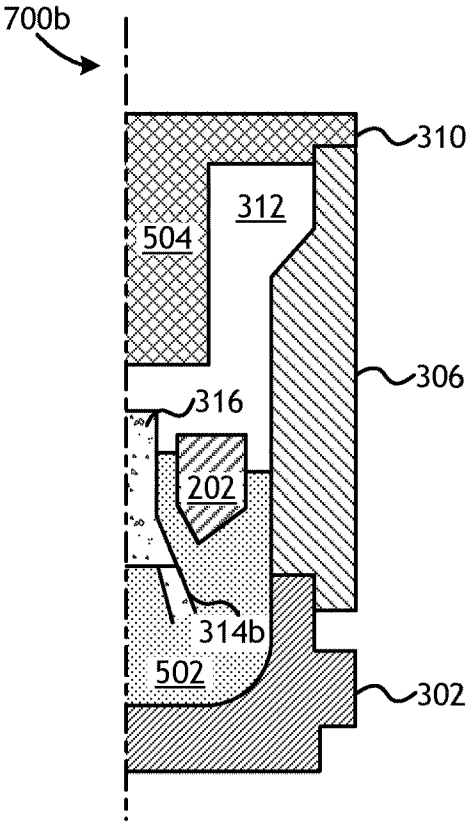
FIGS. 7A-7C are partial cross-sectional side views additional exemplary mold assemblies.
Figure 7A:
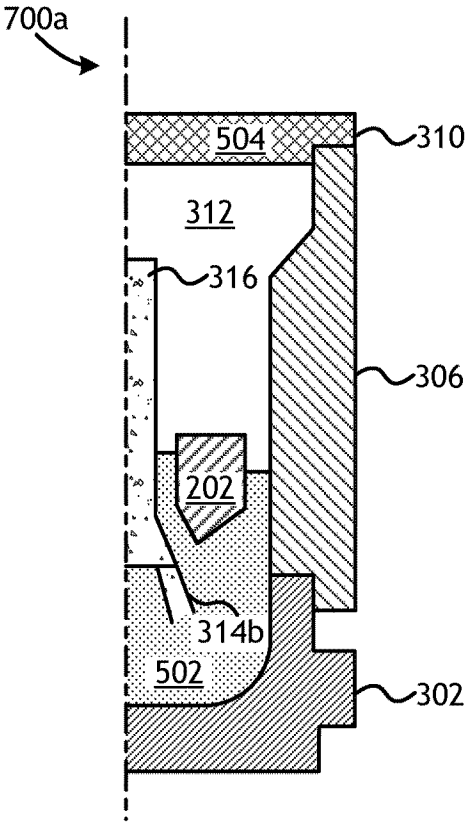
Figure 7C:
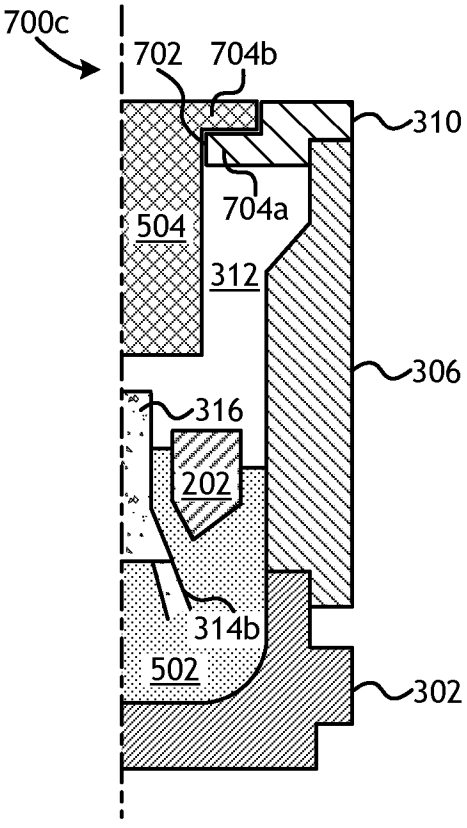

Referring now to FIGS. 7A-7C, illustrated are partial cross-sectional side views of additional exemplary mold assemblies 700 used to fabricate the infiltrated downhole tool 502, according to one or more embodiments. More particularly, FIG. 7A depicts a fifth mold assembly 700*a*, FIG. 7B depicts a sixth mold assembly 700*b*, and FIG. 7C depicts a seventh mold assembly 700*c*. Similar to the mold assemblies 500*a,b* of FIGS. 5A-5B, the mold assemblies 700*a-c* may be similar in some respects to the mold assembly 300 of FIG. 3. As illustrated, the mold assemblies 700*a-c* may each include one or more of the mold 302, the funnel 306, the cap 310, the metal blank 202, the central displacement 316, and one or more consolidated sand legs 314*b* (one shown). The binder bowl 308 (FIG. 3) and the gauge ring 304 (FIG. 3) could alternatively be included in any of the mold assemblies 700*a-c*, without departing from the scope of the disclosure.

Moreover, similar to the mold assemblies 500*a,b* of FIGS. 5A-5B, the mold assemblies 700*a-c* may each include the thermal mass 504 positioned within the infiltration chamber 312 to retain and/or impart additional heat within the given mold assembly 700*a-c* above the infiltrated downhole tool 502 following the infiltration process. Unlike the mold assemblies 500*a,b*, however, the thermal mass in the mold assemblies 700*a-c* may be integrated with the cap 310. In FIGS. 7A and 7B, for example, the thermal mass 504 may form an integral part or extension of the cap 310 or be the cap 310. More particularly, the cap 310 and the thermal mass 504 may be made of the same material or otherwise coupled (e.g., welded, brazed, mechanically fastened, etc.) to form a monolithic component part of the given mold assembly 700*a,b*. In FIG. 7B, the thermal mass 504 may extend longitudinally into the infiltration chamber 312 and toward the central displacement 316. In some embodiments, the height of the central displacement 316 may be reduced to accommodate the volume of the thermal mass 504.

In FIG. 7C, the thermal mass 504 is integrated with the cap 310 in a two-piece construction, where the thermal mass 504 is configured to rest on the cap 310 and extend longitudinally into the infiltration chamber 312. More particularly, the cap 310 may define a central aperture 702 and a radial shoulder 704*a* configured to receive and support the thermal mass 504. The thermal mass 504 may provide or otherwise define a corresponding shoulder 704*b* configured to engage and rest on the radial shoulder 704*a* and thereby "hang off" the cap 310 into the infiltration chamber 312. Those skilled in the art will readily recognize the several potential variations of hanging the thermal mass 504 from the cap 310, without departing from the scope of the disclosure. In some embodiments, for instance, the thermal mass 504 may alternatively be mechanically fastened to the cap 310, such as through the use of one or more mechanical fasteners (e.g., screws, bolts, pins, snap rings, etc.). As with the mold assembly 600*b* of FIG. 6B, the configuration of the mold assembly 700*c* may prove advantageous in providing a removable or interchangeable thermal mass 504 to optimize operation of the mold assembly 700*c* by using different materials for the thermal mass 504. Moreover, similar to the mold assembly 600*b* of FIG. 6B, the thermal mass 504 may be made out of two or more materials (welded or mechanically joined, etc.) so that the cooling process may be optimized if response is needed in between set thermal properties of selected materials of the thermal masses 504. This could also be used to lighten the thermal mass 504 if it proves to be too heavy for the mold 302 that ultimately supports the suspended weight.

Figure 8B:
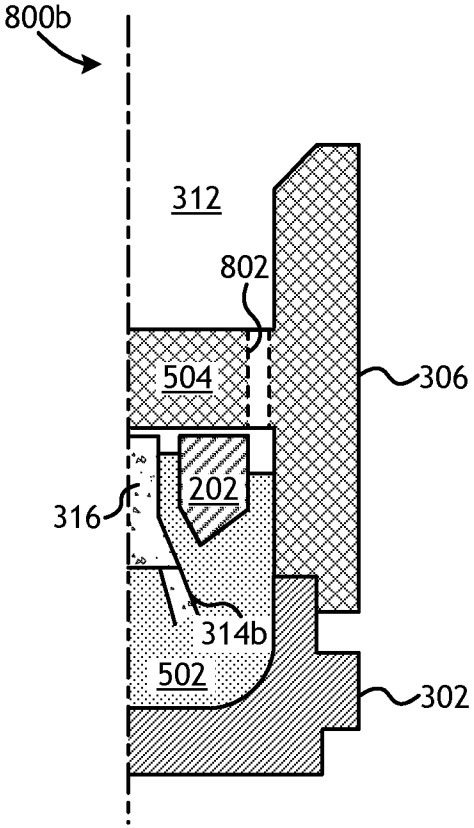
FIGS. 8A-8D are partial cross-sectional side views additional exemplary mold assemblies.
Figure 8A:
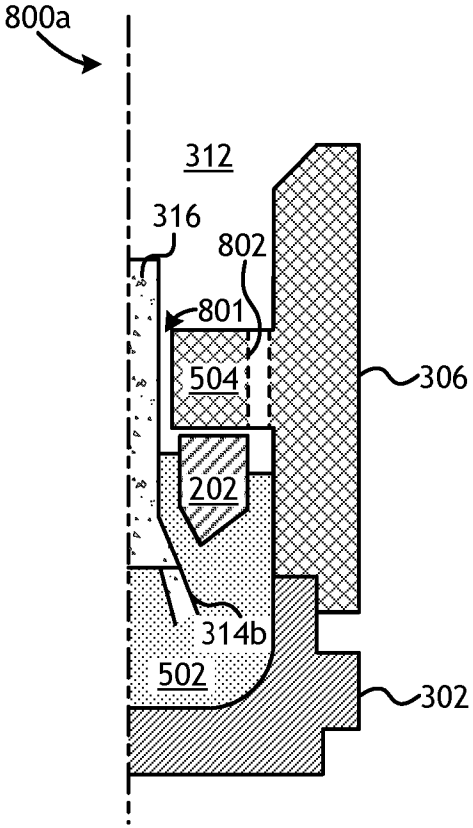
Figure 8C:
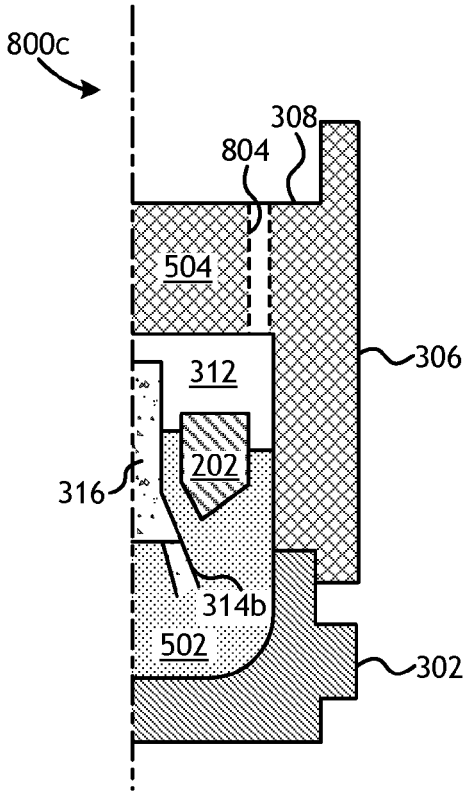
Figure 8D:
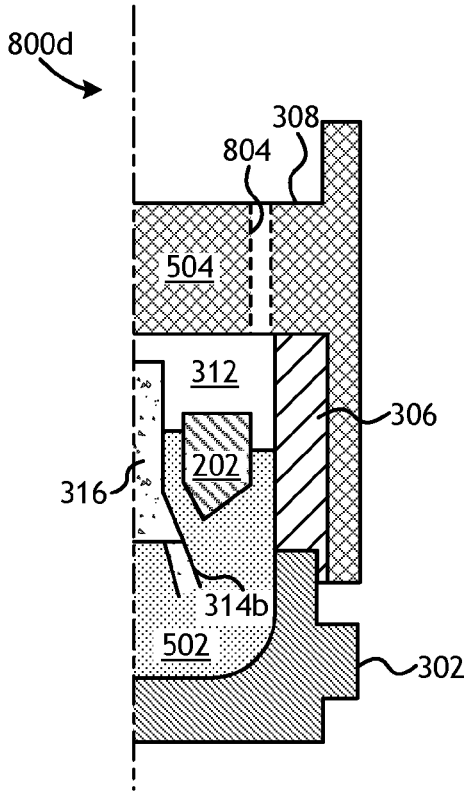

Referring now to FIGS. 8A-8D, illustrated are partial cross-sectional side views of additional exemplary mold assemblies 800 used to fabricate the infiltrated downhole tool 502, according to one or more embodiments. More particularly, FIG. 8A depicts an eighth mold assembly 800*a*, FIG. 8B depicts a ninth mold assembly 800*b*, FIG. 8C depicts a tenth mold assembly 800*c*, and FIG. 8D depicts an eleventh mold assembly 800*f*. Similar to the mold assemblies 500*a,b* of FIGS. 5A-5B, the mold assemblies 800*a-d* may be similar in some respects to the mold assembly 300 of FIG. 3. As illustrated, the mold assemblies 800*a-d* may each include the mold 302, the funnel 306, the metal blank 202, the central displacement 316, and one or more consolidated sand legs 314*b* (one shown). The gauge ring 304 (FIG. 3), the binder bowl 308 (FIG. 3), and the cap 310 (FIG. 3) could alternatively be included in any of the mold assemblies 800*a-d*, without departing from the scope of the disclosure. For instance, mold assembly 800*c* in FIG. 8*c* includes a design that combines the funnel 306 and the binder bowl 308, as discussed in more detail below.

Moreover, similar to the mold assemblies 500*a,b* of FIGS. 5A-5B, the mold assemblies 800*a-d* may each include the thermal mass 504 positioned within the infiltration chamber 312 to retain and/or impart additional heat within the given mold assembly 800*a-d* above the infiltrated downhole tool 502 following the infiltration process. Unlike the mold assemblies 500*a,b*, however, the thermal mass in the mold assemblies 800*a-d* may be integrated with the funnel 306. In FIGS. 8A and 8B, for example, the thermal mass 504 may form an integral part of the funnel 306 or be the funnel 306 itself, and extend radially into the infiltration chamber 312 from the funnel 306. In such embodiments, the funnel 306 and the thermal mass 504 may be made of the same material or otherwise coupled (e.g., welded, brazed, mechanically fastened, etc.) to form a monolithic component part of the given assembly 800*a,b*.

In FIG. 8A, the thermal mass 504 is depicted as an annular ring that extends radially from the funnel 306 and about the central displacement 316. Similar to the metal blank 202, the thermal mass 504 in FIG. 8A may exhibit an inside diameter that is greater than the outside diameter 322 (FIG. 3) of the central displacement 316, thereby allowing the thermal mass 504 to be arranged about the outer periphery of the central displacement 316. A gap 801 defined between the thermal mass 504 and the central displacement 316 may allow the binder material 324 (FIG. 3) to flow around the thermal mass 504 during the infiltration process. In some embodiments, one or more flow conduits 802 (one shown) may further be defined through the thermal mass 504 to enable the binder material 324 (FIG. 3) to also flow through the thermal mass 504.

In FIG. 8B, the thermal mass 504 is depicted as extending radially across the entire infiltration chamber 312 and thereby defining a disk-like structure that is coupled to or otherwise forms an integral part of the funnel 306. In some embodiments, as illustrated, the height of the central displacement 316 may be reduced to accommodate the thermal mass 504. In such embodiments, the thermal mass 504 may be placed atop and in contact with one or both of the central displacement 316 and the metal blank 202. As illustrated, the flow conduit(s) 802 may be defined through the thermal mass 504 to enable the binder material 324 (FIG. 3) to flow through the thermal mass 504 during the infiltration process.

In FIG. 8C, the thermal mass 504 may be integrated with both the funnel 306 and the binder bowl 308 and thereby form a monolithic structure that may be rested on the mold 302. In such embodiments, the funnel 306 may be fused with or otherwise coupled to the binder bowl 308 such that the entire upper portion of the funnel 306 consists of a solid mass, excepting one or more flow conduits 804 (one shown) that may be defined therethrough to enable the binder material 324 (FIG. 3) to flow through the thermal mass 504. Accordingly, the thermal mass 504 may extend both longitudinally and radially into the infiltration chamber 312. The combined volume of the funnel 306 and the binder bowl 308 provides the required material mass to function as a thermal reservoir. In this embodiment, the thermal mass 504 may be made of graphite, but may equally be made of other materials to provide varying levels of heat capacity. For example, the thermal mass 504 may alternatively be made of alumina and the walls of the thermal mass 504 may be thinner to fit within an outer portion of the funnel 306, perhaps made of graphite, and thereby facilitating interchangeable designs for the mold assembly 800*c*. This embodiment may be seen in FIG. 8D, where the thermal mass 504 rests atop and around the funnel 306.

Embodiments disclosed herein include:

A. A mold assembly for fabricating an infiltrated downhole tool includes one or more component parts including at least one of a mold that forms a bottom of the mold assembly and a funnel operatively coupled to the mold, an infiltration chamber defined by at least one of the one or more component parts to receive and contain matrix reinforcement materials and a binder material used to form the infiltrated downhole tool, and a thermal mass positioned within or forming a portion of the infiltration chamber to impart heat to the infiltrated downhole tool following an infiltration process.

B. A mold assembly for fabricating an infiltrated drill bit that includes one or more component parts including at least one of a mold that forms a bottom of the mold assembly and a funnel operatively coupled to the mold, an infiltration chamber defined by at least one of the one or more component parts to receive and contain matrix reinforcement materials and a binder material used to form the infiltrated drill bit, a central displacement arranged within the infiltration chamber and having one or more legs that extend therefrom, a metal blank arranged about the central displacement within the infiltration chamber, and a thermal mass positioned within or forming a portion of the infiltration chamber to impart heat to the infiltrated drill bit following an infiltration process.

C. A method for fabricating an infiltrated downhole tool that includes placing a mold assembly within a furnace, the mold assembly including one or more component parts including at least one of a mold that forms a bottom of the mold assembly, a funnel operatively coupled to the mold, and an infiltration chamber defined by at least one of the one or more component parts, wherein the infiltration chamber contains matrix reinforcement materials and a binder material used to form the infiltrated downhole tool, heating the matrix reinforcement materials and the binder material with the furnace, heating with the furnace a thermal mass positioned within or forming a portion of the infiltration chamber, removing the mold assembly from the furnace to cool the infiltrated downhole tool, and passively imparting heat to the infiltrated downhole tool with the thermal mass.

Each of embodiments A, B, and C may have one or more of the following additional elements in any combination: Element 1: wherein the infiltrated downhole tool is selected from the group consisting of a drill bit, a cutting tool, a non-retrievable drilling component, a drill bit body associated with casing drilling of wellbores, a drill-string stabilizer, cones for a roller-cone drill bit, a model for forging dies used to fabricate support arms for roller-cone drill bits, an arm for a fixed reamer, an arm for an expandable reamer, an internal component associated with expandable reamers, a rotary steering tool, a logging-while-drilling tool, a measurement-while-drilling tool, a side-wall coring tool, a fishing spear, a washover tool, a rotor, a stator, a blade for a downhole turbine, a housing for a downhole turbine, and any combination thereof. Element 2: wherein the thermal mass comprises a material selected from the group consisting of a ceramic, a metal, fireclay, fire brick, stone, graphite, a phase changing material, any composite thereof, and any combination thereof. Element 3: further comprising a binder bowl positioned above the funnel, wherein the thermal mass is integrated with the binder bowl and extends longitudinally into the infiltration chamber from the binder bowl. Element 4: wherein the thermal mass and the binder bowl are made of the same material and form a monolithic component. Element 5: wherein the binder bowl defines a central aperture to receive the thermal mass. Element 6: further comprising a cap positioned above the funnel, wherein the thermal mass is integrated with the cap and extends longitudinally into the infiltration chamber from the cap. Element 7: wherein the thermal mass and the cap are made of the same material and form a monolithic component. Element 8: wherein the cap defines a central aperture to receive the thermal mass. Element 9: wherein the thermal mass is integrated with the funnel and extends radially into the infiltration chamber from the funnel. Element 10: wherein the thermal mass and the funnel are made of the same material and form a monolithic component. Element 11: further comprising a binder bowl fused with the funnel, wherein the thermal mass is integrated with the funnel and the binder bowl.

Element 12: wherein the thermal mass comprises a material selected from the group consisting of a ceramic, a metal, fireclay, fire brick, stone, graphite, a phase changing material, any composite thereof, and any combination thereof. Element 13: wherein the thermal mass is positioned within the infiltration chamber on top of the metal blank. Element 14: wherein the thermal mass is an annular ring that extends about the central displacement. Element 15: wherein the thermal mass is disk-shaped and extends over the central displacement. Element 16: further comprising a binder bowl positioned above the funnel, wherein the thermal mass is integrated with the binder bowl and extends longitudinally into the infiltration chamber from the binder bowl. Element 17: further comprising a cap positioned above the funnel, wherein the thermal mass is integrated with the cap and extends longitudinally into the infiltration chamber from the cap. Element 18: wherein the thermal mass is integrated with the funnel and extends radially into the infiltration chamber from the funnel.

Element 19: wherein the thermal mass comprises a material selected from the group consisting of a ceramic, a metal, fireclay, fire brick, stone, graphite, a phase changing material, any composite thereof, and any combination thereof. Element 20: wherein the mold assembly further includes a central displacement arranged within the infiltration chamber and having one or more legs that extend therefrom, and a metal blank arranged about the central displacement within the infiltration chamber, the method further comprising positioning the thermal mass within the infiltration chamber on top of the metal blank. Element 21: wherein the mold assembly further includes a binder bowl positioned above the funnel and the thermal mass is integrated with the binder bowl, and wherein imparting heat to the infiltrated downhole tool with the thermal mass comprises imparting heat to the infiltrated downhole tool with the thermal mass extending longitudinally into the infiltration chamber from the binder bowl. Element 22: wherein the mold assembly further includes a cap positioned above the funnel and the thermal mass is integrated with the cap, and wherein imparting heat to the infiltrated downhole tool with the thermal mass comprises imparting heat to the infiltrated downhole tool with the thermal mass extending longitudinally into the infiltration chamber from the cap. Element 23: wherein the thermal mass is integrated with the funnel and wherein imparting heat to the infiltrated downhole tool with the thermal mass comprises imparting heat to the infiltrated downhole tool with the thermal mass extending radially into the infiltration chamber from the funnel.

By way of non-limiting example, exemplary combinations applicable to A, B, and C include: Element 3 with Element 4; Element 3 with Element 5; Element 6 with Element 7; Element 6 with Element 8; Element 9 with Element 10; Element 9 with Element 11; Element 13 with Element 14; and Element 13 with Element 15.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A mold assembly for fabricating an infiltrated downhole tool, comprising:

one or more component parts including at least one of a mold that defines a bottom of the mold assembly and a funnel operatively coupled to the mold;

an infiltration chamber defined by at least one of the one or more component parts to receive and contain matrix reinforcement materials and a binder material used to form the infiltrated downhole tool;

a blank positioned within a portion of the infiltration chamber;

a passive thermal mass extending longitudinally within the infiltration chamber configured to impart heat to the infiltrated downhole tool following an infiltration process, wherein a gap is defined between the passive thermal mass and an inner wall of the funnel, the gap allowing the binder material to flow around the passive thermal mass; and a binder bowl positioned above the funnel, wherein the thermal mass is integrated with the binder bowl and extends longitudinally into the infiltration chamber from the binder bowl.

2. The mold assembly of claim 1, wherein the infiltrated downhole tool is selected from the group consisting of a drill bit, a cutting tool, a non-retrievable drilling component, a drill bit body associated with casing drilling of wellbores, a drill-string stabilizer, cones for a roller-cone drill bit, a model for forging dies used to fabricate support arms for roller-cone drill bits, an arm for a fixed reamer, an arm for an expandable reamer, an internal component associated with expandable reamers, a rotary steering tool, a logging-while-drilling tool, a measurement-while-drilling tool, a side-wall coring tool, a fishing spear, a washover tool, a rotor, a stator, a blade for a downhole turbine, and a housing for a downhole turbine.

3. The mold assembly of claim 1, wherein the thermal mass comprises a material selected from the group consisting of a ceramic, a metal, fireclay, fire brick, stone, graphite, a phase changing material, any composite thereof, and any combination thereof.

4. The mold assembly of claim 1, wherein the thermal mass and the binder bowl are made of the same material and form a monolithic component.

5. The mold assembly of claim 1, wherein the binder bowl defines a central aperture to receive the thermal mass.

* * * * *